US012220030B1

(12) United States Patent
Kahanets

(10) Patent No.: US 12,220,030 B1
(45) Date of Patent: Feb. 11, 2025

(54) WEARABLE RING WITH REPLACEABLE STAMP FOR ICE CUBES

(71) Applicant: Vitaliy Kahanets, Northbrook, IL (US)

(72) Inventor: Vitaliy Kahanets, Northbrook, IL (US)

( * ) Notice: Subject to any disclaimer, the term of this patent is extended or adjusted under 35 U.S.C. 154(b) by 0 days.

(21) Appl. No.: 18/233,267

(22) Filed: Aug. 11, 2023

(51) Int. Cl.
*A44C 9/00* (2006.01)
*B44B 7/02* (2006.01)

(52) U.S. Cl.
CPC ..... *A44C 9/0061* (2013.01)

(58) Field of Classification Search
CPC ..... A44C 9/0061; A44C 5/0007; A44C 5/003; A44C 9/0053; A44C 9/0069; A44C 9/0084; A44C 15/0025; A44C 17/0208; A44C 25/001; A44C 9/00; A44C 15/004; B43M 1/02; B43M 1/00; B44B 7/02
USPC ..... 425/385, 386; 63/15, 40
See application file for complete search history.

(56) References Cited

U.S. PATENT DOCUMENTS 902,109 A * 10/1908 Hellberg ..... A61C 19/006 224/217
D51,047 S * 7/1917 Ramsberger ..... D11/30
1,510,594 A * 10/1924 Hellberg ..... B43M 1/00 101/28
3,768,947 A * 10/1973 Duneier ..... B43M 1/00 101/399
9,756,909 B1 * 9/2017 Bonner ..... A44C 25/007
2013/0055760 A1 * 3/2013 Rush ..... A63F 11/0002 63/1.14
2014/0090418 A1 * 4/2014 Mihalyo ..... A44C 5/0084 63/3
2016/0143315 A1 * 5/2016 Schuricht ..... A44B 15/00 426/135
2016/0353846 A1 * 12/2016 Zanghi ..... A44C 5/0053
2020/0100571 A1 * 4/2020 Green ..... A44C 17/0225

* cited by examiner

*Primary Examiner* — Jack W Lavinder
(74) *Attorney, Agent, or Firm* — Chicago IP Law; Steven M. Evans

(57) ABSTRACT

A wearable flexible ring configured to hold an interchangeable stamp for ice cubes of different shapes for drinks. The ring allows users to stamp various patterns or designs on ice cubes, enhancing the aesthetics of beverages and creating an enjoyable experience for consumers. The flexible ring is comfortable to wear and includes a receptacle for securing a stamp that can be readily interchanged with a stamp having a different design.

18 Claims, 8 Drawing Sheets

WEARABLE RING WITH REPLACEABLE STAMP FOR ICE CUBES

BACKGROUND OF THE INVENTION

Field of the Invention

The present invention relates generally to handheld stamps, and more particularly, stamps for ice, including clear ice to be used in drinks.

Description of Related Art

Bar and other drinking establishments are always looking for ways to improve the atmosphere and unique experience of their patrons. One such technique is to use completely clear or transparent ice cubes in their drinks. Another technique is to actually stamp the ice cubes in their drinks with difference logos, symbols, or wording. The concept of enhancing the aesthetics of beverages through visually appealing ice cubes has become increasingly popular in the hospitality industry and among beverage enthusiasts.

Traditional ice cubes often lack visual appeal, which may lead to a mundane drinking experience. Various attempts have been made in the past to address the issue of visually unappealing ice cubes. Some solutions include specialized ice cube trays with unique shapes or patterns. However, these trays often require time-consuming freezing processes and may not offer sufficient design options for customization. Additionally, using intricate molds can be challenging, as the design might not come out clearly or might be difficult to handle without breaking the ice. The existing solutions also lack the flexibility and ease of use required to meet consumers' demands for customization and personalization of their beverages.

Accordingly, there is a need for an improved ice cube stamp that offers variable designs, is convenient to use, easily assessible, and provides clear impressions.

ASPECTS AND SUMMARY OF THE PRESENT INVENTION

One aspect of the present invention is to provide a stamp for ice that is more convenient to use.

Another aspect of the present invention is to provide an ice cube stamp that is readily available and comfortable to use.

A further aspect of the present invention is to provide an ice stamp having an easily changeable stamp for the convenience of the user.

An additional aspect of the present invention is to provide an economical ice stamp, which also is kept clean as a user washes their hands.

Another aspect of the present invention is to provide an ice stamp for drinks that is comfortable and convenient to use by bartenders, as it is to be located on the hand.

In order to provide these aspects and others, the present invention provides a wearable flexible ring configured to hold an interchangeable stamp for ice cubes for drinks. The ring allows users to stamp various patterns or designs on ice cubes, enhancing the aesthetics of beverages and creating an enjoyable experience for consumers. The flexible ring is comfortable to wear and includes a receptacle for securing a stamp within the receptacle that can be readily interchanged with other stamps having different designs.

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed invention and specific embodiments as a basis for designing or modifying other structures for carrying out the same purposes of the present invention, and that such other structures do not depart from the spirit and scope of the invention in its broadest form.

DETAILED DESCRIPTION OF THE PREFERRED EMBODIMENT

Figure 1:
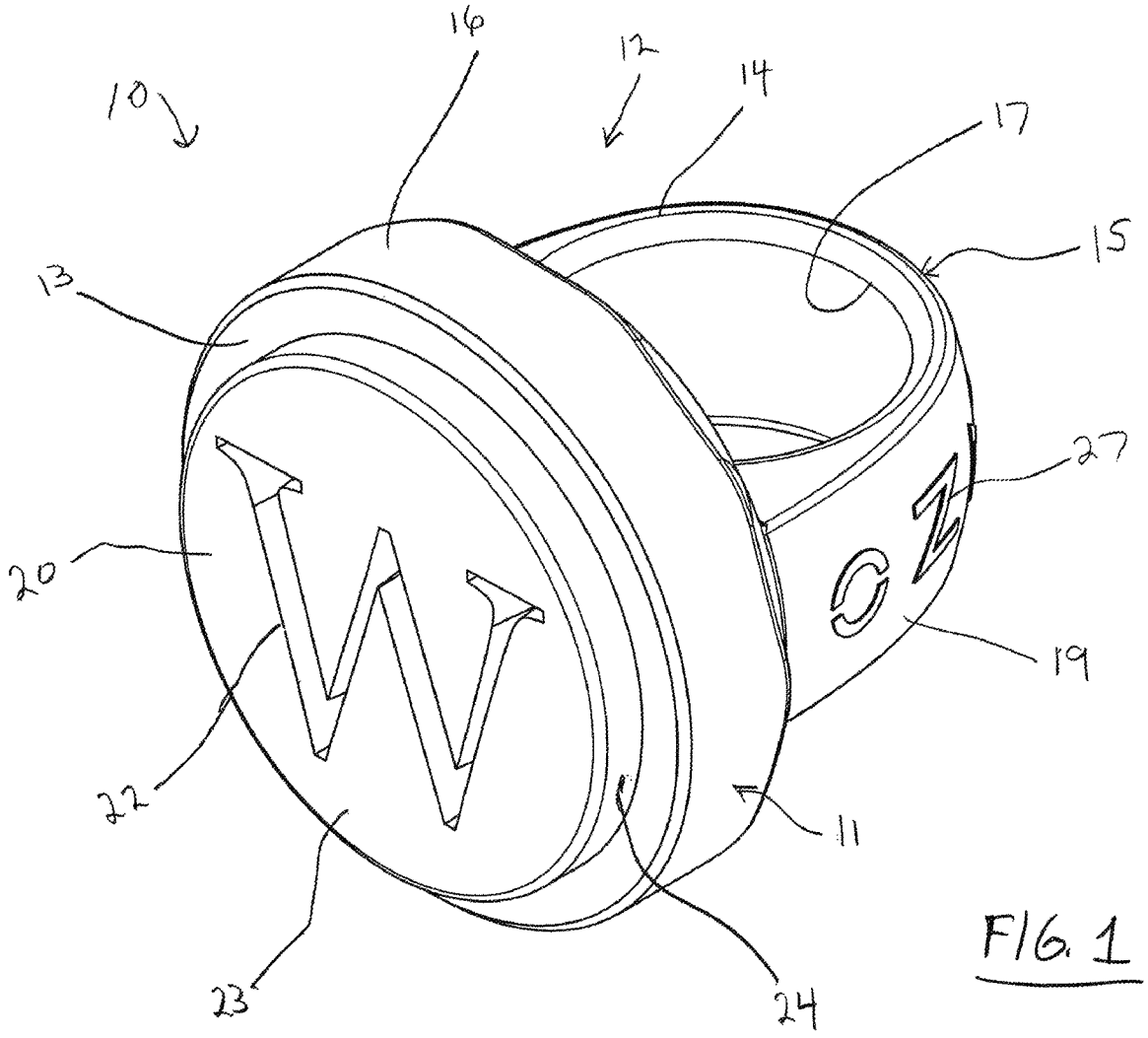
FIG. 1 is a perspective view of a wearable stamp ring configured in accordance with the present invention.

Referring now to the drawings, FIG. 1 is a perspective view of a wearable stamp ring with a replaceable stamp for ice cubes 10 configured in accordance with the present invention. The ring 10 includes a body 12 having a shank 14 and a shoulder 16. The shank 14 has a bottom 15 and an inner surface 17 and an outer surface 19. In some embodiments the outer surface 19 of the shank 14 can include text or other images 27. The shoulder 16 includes an outer perimeter surface or side surface 11 and a top surface 13.

Figure 2:
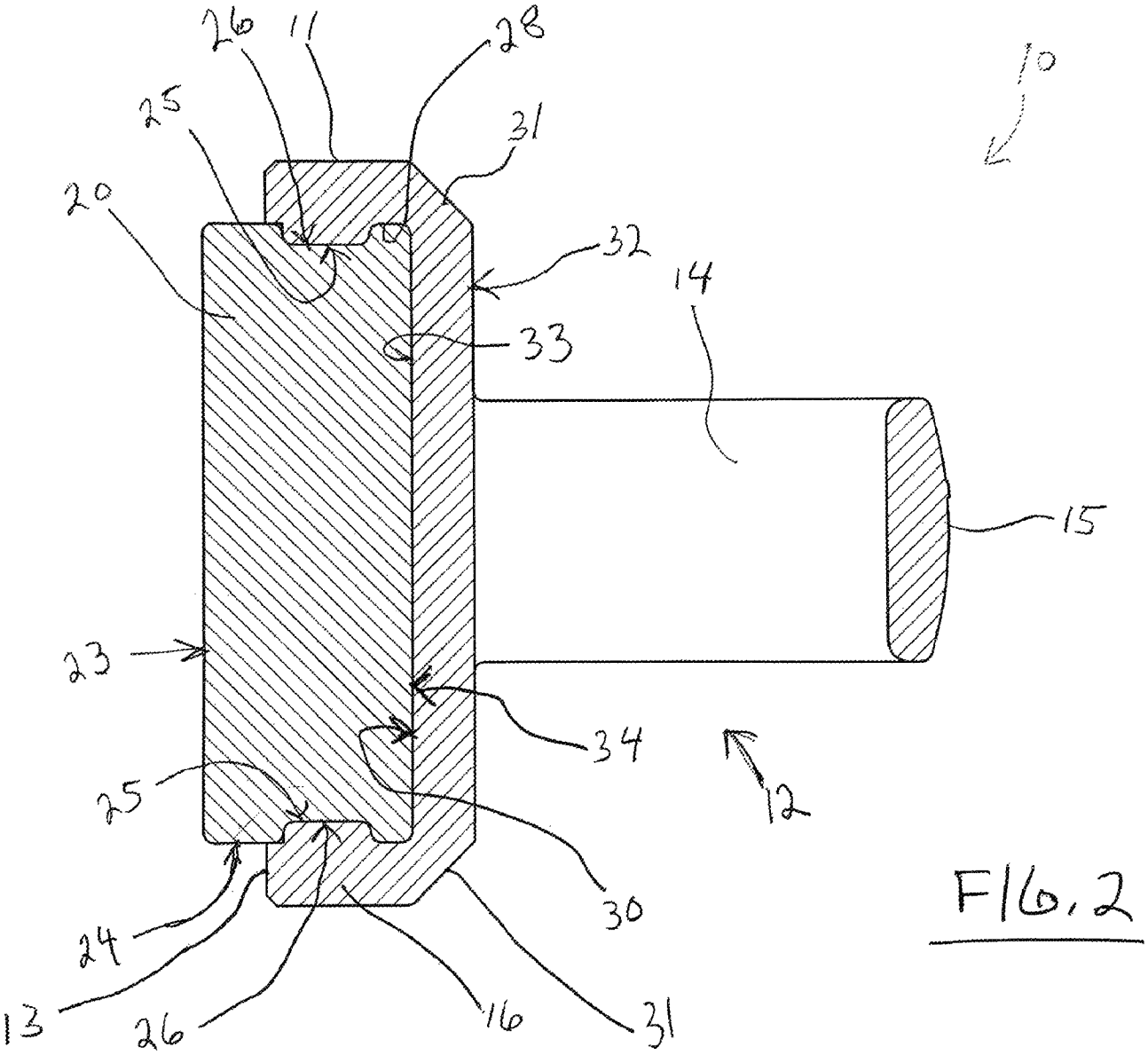
FIG. 2 is a cross-sectional side view of the stamp ring shown in FIG. 1.
Figure 2A:
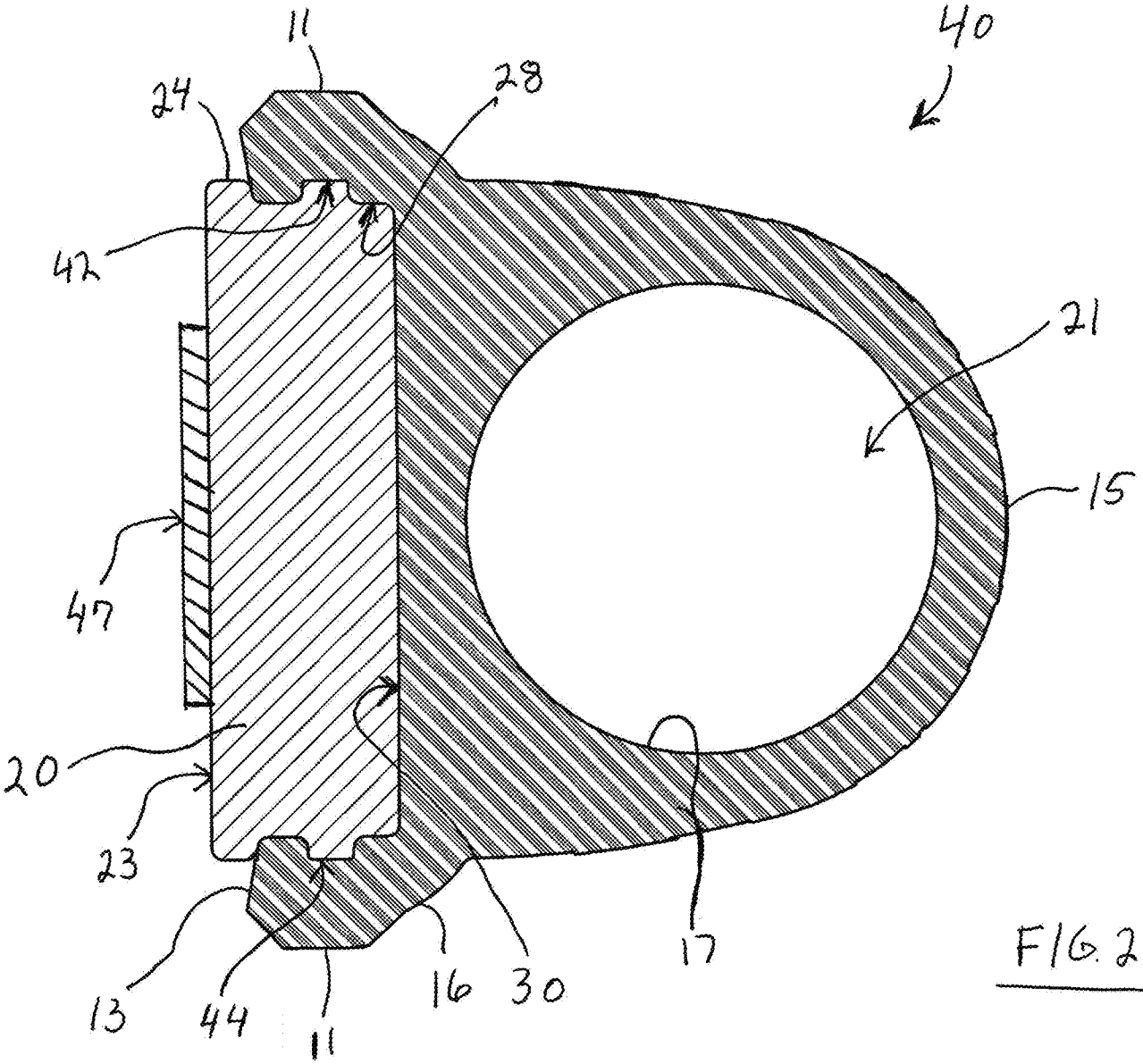
FIG. 2*a* is a cross-section side view of a stamp ring configured in accordance with another embodiment of the present invention.

In accordance with the present invention, a stamp 20 is located within a receptacle 30 located in the top 13 of the shoulder 16, as shown in FIGS. 1 and 2. A top surface 23 of the stamp 20 includes an image 22 that may include a picture, logo, text, or any type of visual and palpable image 22. The image 22 can be engraved within the top surface 23, as shown in FIG. 1, or raised above the top surface 23 of the stamp 20, as shown in FIG. 2*a*. A side surface or perimeter surface 24 of the stamp 20 preferably includes a groove or slot 26 that receives an outer rim or ridge 25 on the inner perimeter surface 28 of the receptacle 30.

In other embodiments, such as ring 40 shown in FIG. 2*a*, the receptacle 30 can include a groove 42 on the inner perimeter surface 28, and the stamp 20 can include a rim or ridge 44 on the outer perimeter 24, wherein the ridge 44 of the stamp 20 fits into the groove or slot 42 in the receptacle 30 of the ring 40 to secure the stamp 20 within the ring 40. Additionally, as shown in FIG. 2*a*, the visual and/or palatable image 47 on the top surface 23 of the stamp 20 can be raised instead of engraved. FIG. 2*a* also shows the finger hole 21 of the ring 40.

The body 12 preferably is constructed of a flexible material, such as rubber. The shank 14 and the shoulder 16 also preferably are constructed as a unitary member. The stamp 20 preferably is constructed of a rigid material, such as metal. The flexible body 12 provides a user with added comfort while wearing the stamp ring 10. The flexible body 12 and the replaceable stamp 20 enable a user to quickly and easily remove a stamp 20 from the receptacle 30 and replace the prior stamp 20 with another stamp 20 having a different image 22. The flexible construction of the shoulder 16 and receptacle 30 contained therein is flexible, so the receptable 30 is expanded to remove and replace a stamp 20, while contracting to secure a new stamp 20 within the receptacle 30. Additionally, the wearable stamp ring 10 is very convenient for a user, such as a bar tender, as the ring 10 is readily available on his or her hand to make an impression on an ice cube for a drink or for some other purpose.

The cross-sectional view provided in FIG. 2 illustrates additional details of the stamp 20 in the receptacle 30, which is located in the shoulder 16. The bottom 34 of the stamp 20 rests on the bottom surface 33 of the receptacle 30. The bottom 32 of the shoulder 16 also is shown along with the tapered or slanted transition 31 from the bottom 32 of the shoulder 16 to the side 11 of the shoulder 16. The top 23 and peripheral surface or side 24 of the stamp 20 are shown. The groove 26 in the side or periphery 24 of the stamp 20 that receives the ridge or rim 25 on the inner side surface 28 of the receptacle 30 is shown.

In the preferred embodiment, the flexible shoulder 16 containing the receptacle 30 is stretched away from the side 24 of the stamp 20 to release the stamp 20 from the receptacle 30, and a new stamp 20 can then be inserted into the receptacle 30. The rim 25 of the receptacle 30 is inserted into the groove 26 of the stamp 20 in order to secure the stamp 20 within the receptacle 30 of the shoulder 16.

Figure 3:
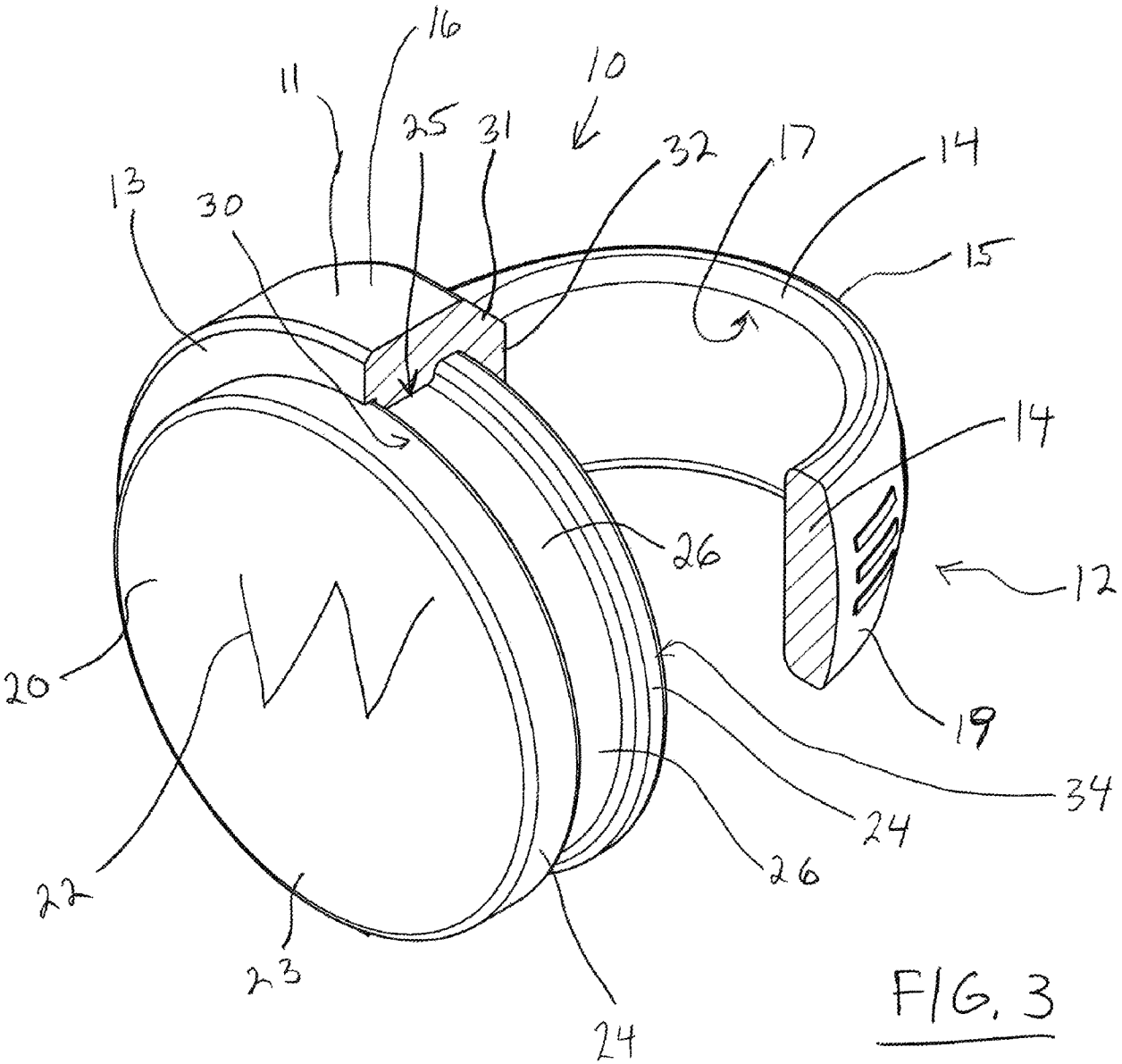
FIG. 3 is a cut-away view of the stamp ring shown in FIGS. 1 and 2.

FIG. 3 illustrates a cut-away view of the ring 10 to provide another view of the elements of the ring 10. Illustrated are the shank 14 and shoulder 16 of the body 12. The inner surface 17 and outer surface 19 of the shank 14 are illustrated. The top 23, side 24, and engraved image 22 of the stamp 20 are shown, as well as the outer peripheral surface or side 11 and the top 13 of the shoulder 16. The clear illustration of the rim or ridge 25 of the receptacle 30 is shown located within the groove 26 of the stamp 20. The side wall 24 and bottom 34 of the stamp 20 are shown, as well as the transition angled side 31 from the side 11 of the shoulder 16 to the bottom 32 of the shoulder 16.

Figure 4:
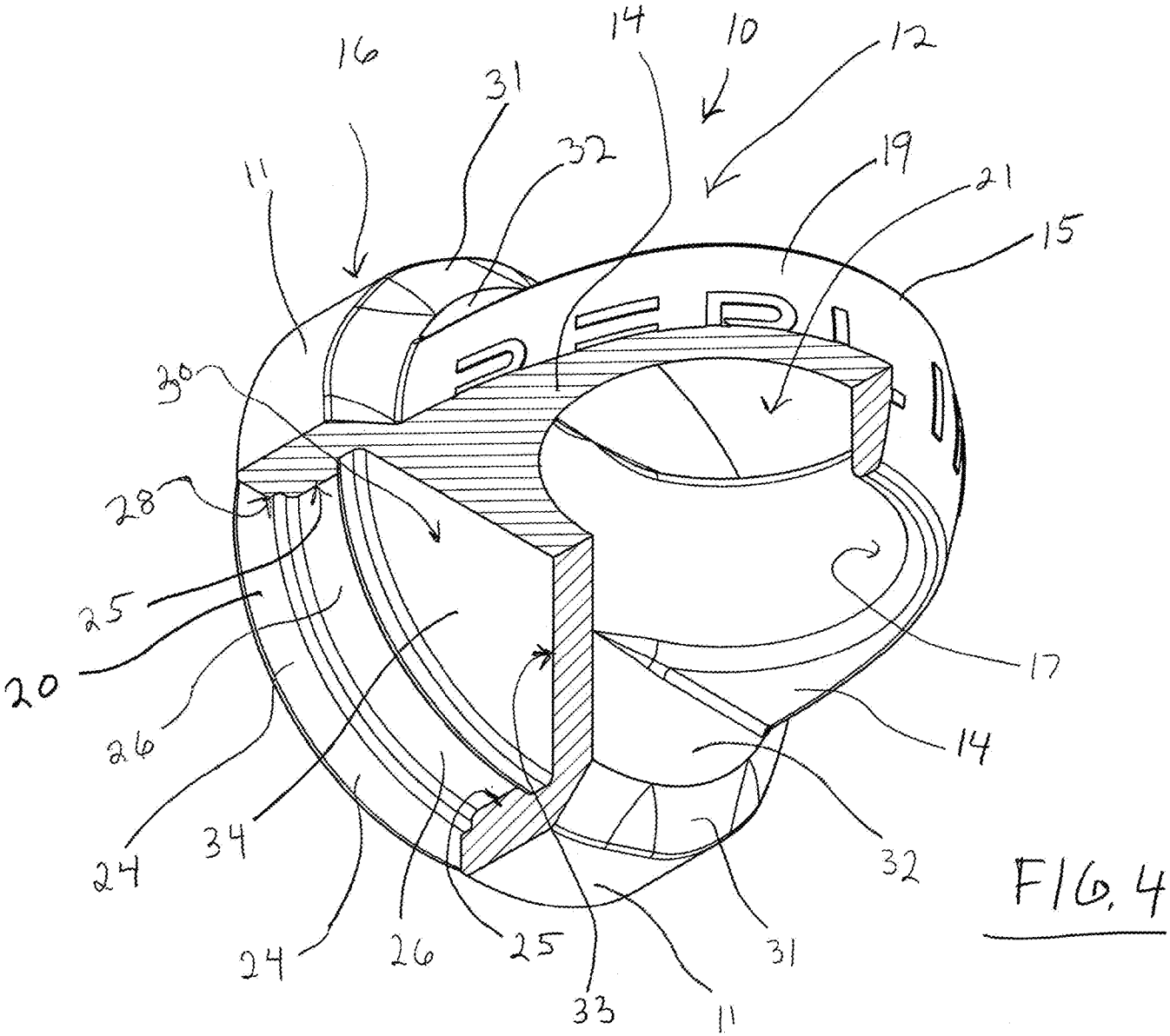
FIG. 4 is another cut-away view of the stamp ring shown in FIGS. 1, 2, and 3.

FIG. 4 illustrates another cut-away illustration of the ring 10. Illustrated are the shank 14 and shoulder 16 of the body 12. The bottom 15, inner 17 and outer 19 surfaces of the shank 14 are shown. Also shown is the finger hole 21 of the shank 14. The side wall 11, transition angled side 31, and bottom 32 of the shoulder 16 are illustrated. The bottom surface 33, inner surface or sidewall 28, and rim 25 of the receptacle 30 are further illustrated. The stamp 20 is shown within the receptacle 30, wherein the rim 25 of the receptacle 30 can be seen within the groove 26 of the stamp 20. The bottom 34 and the sidewall 24 of the stamp 20 are clearly shown too.

Figure 5:
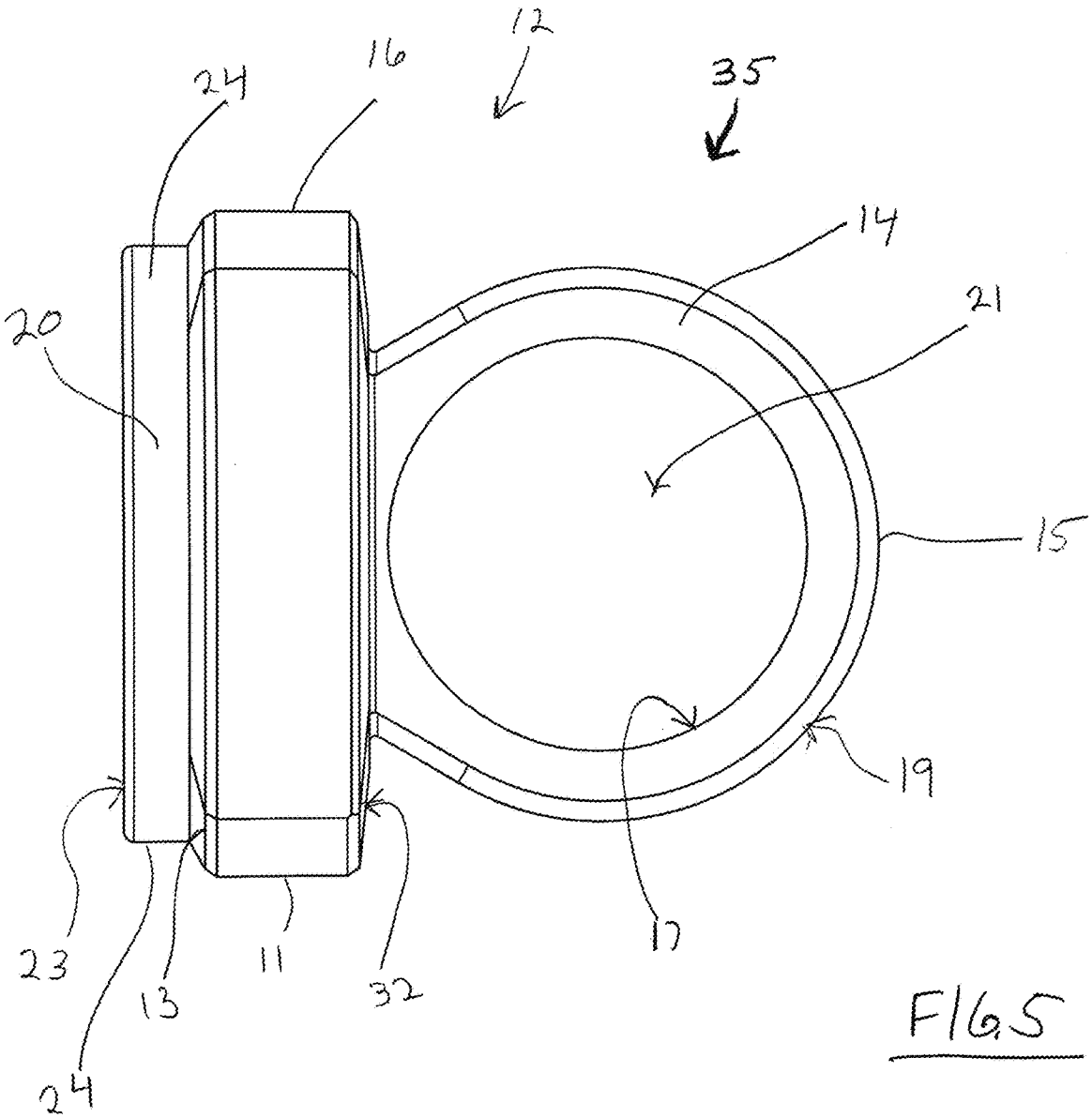
FIG. 5 is a side view of a stamp ring configured in accordance with another embodiment of the present invention.

FIG. 5 illustrates a sideview of a ring 35 configured in accordance with another embodiment of the present invention showing the body 12 including the shank 14 and the shoulder 16. The finger hole 21, outer surface 19, bottom 15, and inner surface 17 of the shank 12 are clearly shown. The side 11, top 13, and bottom 32 of the shoulder 16 are shown. Further illustrated is the sidewall 24 of the stamp 20.

Figure 6:
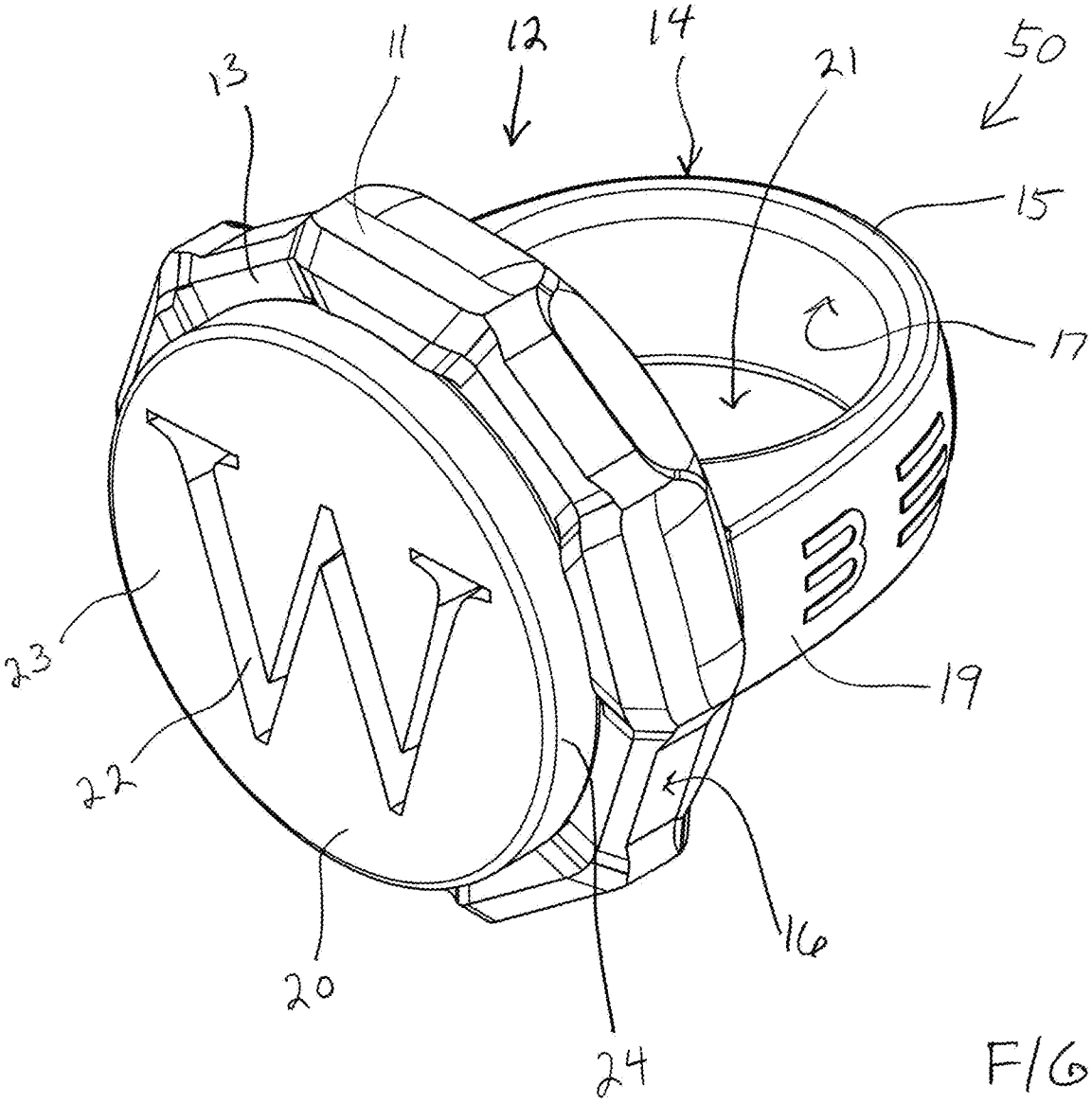
FIG. 6 is a perspective view of a stamp ring configured in accordance with another embodiment of the present invention.

FIG. 6 illustrates a wearable stamp ring 50 configured in accordance with another embodiment of the present invention. The ring 50 includes a body 12 having a shank 14 and a shoulder 16. Illustrated are the finger hole 21, the inner surface 17, the outer surface 19, and the bottom 15. The sidewall 11 and top 13 of the shoulder 16 are shown, as well as the top 23, image 22, and sidewall 24 of the stamp 20. Ring 50 is similar to ring 10 shown in FIG. 1, except the sidewall 11 and top 13 of the shoulder 16 have a different configuration.

Figure 7:
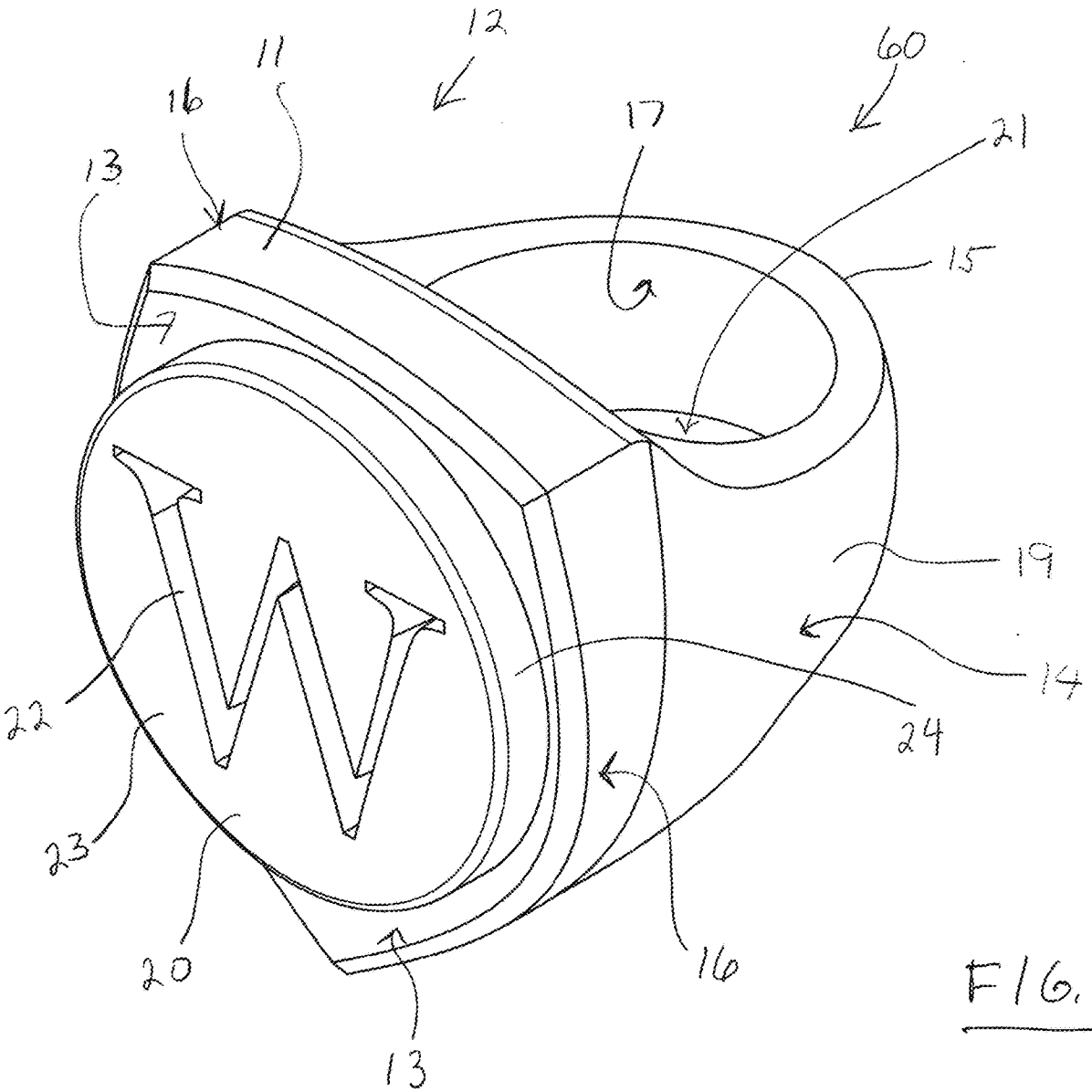
FIG. 7 is a perspective view of a stamp ring configured in accordance with a further embodiment of the present invention.

FIG. 7 illustrates a wearable stamp ring 60 configured in accordance with a further embodiment of the present invention. The ring 60 includes a body 12 having a shank 14 and a shoulder 16. Illustrated are the finger hole 21, the inner surface 17, the outer surface 19, and the bottom 15. The sidewall 11 and top 13 of the shoulder 16 are shown, as well as the top 23, image 22, and sidewall 24 of the stamp 20. Ring 60 is similar to ring 10 shown in FIG. 1, except the sidewall 11 and top 13 of the shoulder 16 have a different configuration. Additionally, the shank 14 of ring 60 has a different configuration than the shank 14 of the ring 10.

While specific embodiments have been shown and described to point out fundamental and novel features of the invention as applied to the preferred embodiments, it will be understood that various omissions and substitutions and changes of the form and details of the invention illustrated and in the operation may be done by those skilled in the art, without departing from the spirit of the invention.

The invention claimed is:

1. A wearable ring with a replaceable stamp for ice cubes, comprising:

a body constructed of flexible material including a shoulder on a shank, wherein the shank is configured to go around a finger of a user;

the shoulder including a receptacle for receiving a stamp with an image, wherein the receptacle includes a ridge on an inner surface for securing a stamp within the receptacle;

a stamp located within the receptacle having an image on a top surface and a groove on an outer edge of the stamp for interlocking with the ridge on the inner surface of the receptacle for securing the stamp within the receptacle; and wherein the shank is attached to, below, and within an outer perimeter of the shoulder in order to provide structural support when the stamp located within the receptacle is to be pressed against an ice cube to form an image in the ice cube.

2. The wearable ring of claim 1, wherein the stamp is constructed of a rigid material.

3. The wearable ring of claim 1, wherein the image on the stamp is engraved.

4. The wearable ring of claim 1, wherein the image on the stamp is raised above the top surface of the stamp.

5. The wearable ring of claim 1, wherein the image includes text.

6. The wearable ring of claim 1, wherein the image includes a logo.

7. The wearable ring of claim 1, wherein the receptacle has a circular configuration.

8. The wearable ring of claim 1, wherein the stamp has a circular configuration.

9. The wearable ring of claim 1, wherein the body is constructed as a unitary member.

10. A wearable ring with a replaceable stamp for ice cubes, comprising:

a body constructed of flexible material including a shoulder on a shank, wherein the shank is configured to go around a finger of a user;

the shoulder including a receptacle for receiving a stamp with an image, wherein the receptacle includes a groove on an inner surface for securing a stamp within the receptacle;

a stamp located within the receptacle having an image on a top surface and a rim on an outer edge for interlocking within the groove on the inner surface of the receptacle for securing the stamp within the receptacle; and wherein the shank is attached to, below, and within an outer perimeter of the shoulder in order to provide structural support when the stamp located within the receptacle is to be pressed against an ice cube to form an image in the ice cube.

11. The wearable ring of claim 10, wherein the stamp is constructed of a rigid material.

12. The wearable ring of claim 10, wherein the image on the stamp is engraved.

13. The wearable ring of claim 10, wherein the image on the stamp is raised above the top surface of the stamp.

14. The wearable ring of claim 10, wherein the image includes text.

15. The wearable ring of claim 10, wherein the image includes a logo.

16. The wearable ring of claim 10, wherein the receptacle has a circular configuration.

17. The wearable ring of claim 10, wherein the stamp has a circular configuration.

18. The wearable ring of claim 10, wherein the body is constructed as a unitary member.

* * * * *